US008794474B2

(12) United States Patent
Mueller et al.

(10) Patent No.: US 8,794,474 B2
(45) Date of Patent: Aug. 5, 2014

(54) CHILD RESISTANT CONCENTRATE CARTRIDGE AND ASSOCIATED DILUTING AND DISPENSING CONTAINER

(75) Inventors: Edward L. Mueller, Toledo, OH (US); Douglas F. Taylor, Toledo, OH (US)

(73) Assignee: iDispense, LLC, Toledo, OH (US)

( * ) Notice: Subject to any disclaimer, the term of this patent is extended or adjusted under 35 U.S.C. 154(b) by 225 days.

(21) Appl. No.: 11/720,637

(22) PCT Filed: May 31, 2007

(86) PCT No.: PCT/US2007/070098

§ 371 (c)(1), (2), (4) Date: Jun. 1, 2007

(87) PCT Pub. No.: WO2007/143503

PCT Pub. Date: Dec. 13, 2007

(65) Prior Publication Data

US 2009/0289025 A1 Nov. 26, 2009

Related U.S. Application Data

(60) Provisional application No. 60/810,329, filed on Jun. 2, 2006.

(51) Int. Cl.
*B65D 81/32* (2006.01)
*B05B 11/00* (2006.01)

(52) U.S. Cl.
CPC ..... *B05B 11/0081* (2013.01)
USPC ..... 220/521; 215/44; 222/129; 222/325; 222/383.1; 222/510

(58) Field of Classification Search
CPC ..... B65D 81/32; B05B 11/00
USPC ..... 215/44; 220/521; 222/129, 325, 383.1, 222/510
See application file for complete search history.

(56) References Cited

U.S. PATENT DOCUMENTS

| | | | | |
|---|---|---|---|---|
| 5,421,483 | A | 6/1995 | Parise | |
| 5,638,994 | A * | 6/1997 | Libit et al. | 222/207 |
| 6,041,969 | A * | 3/2000 | Parise | 222/129 |
| 6,182,865 | B1 | 2/2001 | Bunschoten et al. | |
| 6,290,100 | B1 | 9/2001 | Yacko et al. | |

OTHER PUBLICATIONS

U.S. Appl. No. 11/677,775, filed Feb. 22, 2007, JAWS International.
U.S. Appl. No. 11/684,814, filed Apr. 3, 2006, JAWS International.

* cited by examiner

*Primary Examiner* — Fenn Mathew
*Assistant Examiner* — Elizabeth Volz
(74) *Attorney, Agent, or Firm* — Fraser Clemens Martin & Miller LLC; J. Douglas Miller

(57) ABSTRACT

A reusable concentrate cartridge adapted to be supported by a diluting and dispensing container for combining at least two separate components of a multi-component system, the concentrate cartridge having a hollow cylindrical element and a hollow tube with a closure portion. The concentrate cartridge is caused to open by the rotating engagement of a closure cap onto the diluting and dispensing container to which causes the closure portion of the hollow tube to disengage, releasing the concentrate material.

19 Claims, 4 Drawing Sheets

CHILD RESISTANT CONCENTRATE CARTRIDGE AND ASSOCIATED DILUTING AND DISPENSING CONTAINER

CROSS-REFERENCE TO RELATED APPLICATION

This application claims the benefit of U.S. Provisional Patent Application Ser. No. 60/810,329 filed Jun. 2, 2006.

FIELD OF THE INVENTION

The invention relates to a container system for dispensing fluids and more particularly to a closure portion of a container for dispensing a solution including a concentrated material and a liquid diluent and a concentrate cartridge for use in the container.

BACKGROUND OF THE INVENTION

Presently there are available dispensing containers for multi-constituent systems, which are designed to receive reusable concentrate containing cartridges. The concentrate material is supplied in a separately packaged cartridge that is easily inserted into the neck of a reusable diluting and dispensing container.

One such cartridge is described in U.S. Pat. No. 6,290,100 to Yacko et al. entitled CONCENTRATE CARTRIDGE FOR A DILUTING AND DISPENSING CONTAINER, incorporated herein by reference in its entirety.

The concentrate cartridge disclosed in the '100 patent includes a hollow cylindrical element having a first open end forming a closure seat and a second end including a flange extending radially outwardly from the cylindrical element, and a hollow tube having a first end portion in a substantially fluid tight sliding relation with the second end of the cylindrical element and a second end terminating in a radially outwardly extending closure adapted to selectively seat with the closure seat of the hollow cylindrical element to form a fluid tight seal therebetween.

The radially outwardly extending closure is opened in response to a downward force applied to the first end portion of the hollow tube, wherein the closure element is caused to unseat from the closure seat of the cylindrical element. The hollow cylindrical body of the cartridge is held in place in the dispensing container wherein the lower surface of the radially outwardly extending flange of the cartridge is supported on an upper land portion of the neck of the container.

A closure cap is utilized to apply axial force to urge the hollow tube downwardly until the closure is opened allowing the concentrated material to be released from the cartridge into the interior of the container. Simultaneously, the downward force of the closure cap effects a sealing relationship between the undersurface of the flange of the cartridge and the upper land surface of the neck of the container.

The resulting mixture of the constituents, the concentrated material in the cartridge and the dilutant in the container, is dispensed from the container through a dip tube and a dispensing orifice as a spray or a stream of liquid in response to activation of a hand-pump associated with the closure cap.

Since the cartridge and container may be utilized to contain fluids which might be dangerous for children as well as adults, it would be desirable to produce a concentrate-containing cartridge and associated dilutant-containing container which could be opened only by specifically designed equipment and may not typically be opened by children or adults without use of such equipment.

SUMMARY OF THE INVENTION

In concordance and agreement with the present invention, a concentrate cartridge and associated container which could be opened only by specifically designed equipment and may not typically be opened by children or adults without use of such equipment, has surprisingly been discovered.

In one embodiment, a container comprising a neck portion having an open end adapted to receive a cartridge and an associated closure cap, wherein the cartridge includes a hollow tube recessed within an annular collar of a hollow cylindrical element and the closure cap includes a collar attached thereto; and a main body having a hollow interior in communication with the neck portion.

In another embodiment, a container system comprising a main body having a hollow interior, a first closed end, and a spaced apart second end, the second end including a neck portion having an open end and adapted to receive an associated closure cap, wherein the closure cap includes a collar attached thereto; and a cartridge adapted to be disposed in the neck portion of the main body, the cartridge having a hollow tube recessed within an annular collar of a hollow cylindrical element.

In another embodiment, a dispensing system comprising a main body having a hollow interior for containing a liquid diluent, a first closed end, and a spaced apart second end, the second end including a neck portion having an open end and external threads formed thereon; a cartridge for containing a concentrated material adapted to be disposed in the neck portion of the main body, the cartridge including a hollow cylindrical element having a first open end forming a closure seat and a second end including a flange extending outwardly of said hollow cylindrical element, an annular collar, and an annular web having a generally U-shaped cross-section interconnecting the annular collar and the flange of the first cylindrical element; and a hollow tube having a first end portion in fluid-tight sliding relation and recessed within the annular collar of said hollow cylindrical element, and a second end terminating into a radially outwardly extending closure adapted to selectively seat with the closure seat of said hollow cylindrical element to form a fluid-tight closure therebetween; and a dispensing device including a closure cap rotatably coupled to a dispenser, wherein the closure cap includes internal threads formed thereon adapted to engage external threads of the neck portion of the main body to provide a tight seal, and a collar attached thereto adapted to urge the hollow tube to a position to unseat the closure of the hollow tube having a beveled annular surface to facilitate seating with the closure seat of the hollow cylindrical element; and the dispenser includes a dip tube inserted through the hollow tube of the cartridge and into the main body.

BRIEF DESCRIPTION OF THE DRAWINGS

The above and other objects and advantages of the invention will become readily apparent to those skilled in the art from reading the following detailed description of the invention when considered in the light of the accompanying drawings, in which.

DETAILED DESCRIPTION OF THE PREFERRED EMBODIMENTS OF THE INVENTION

The following detailed description and appended drawings describe and illustrate an exemplary embodiment of the present invention. The description and drawings serve to enable one skilled in the art to make and use the invention, and are not intended to limit the scope of the invention in any manner. It is understood that materials other than those described can be used without departing from the scope and spirit of the invention.

Figure 1:
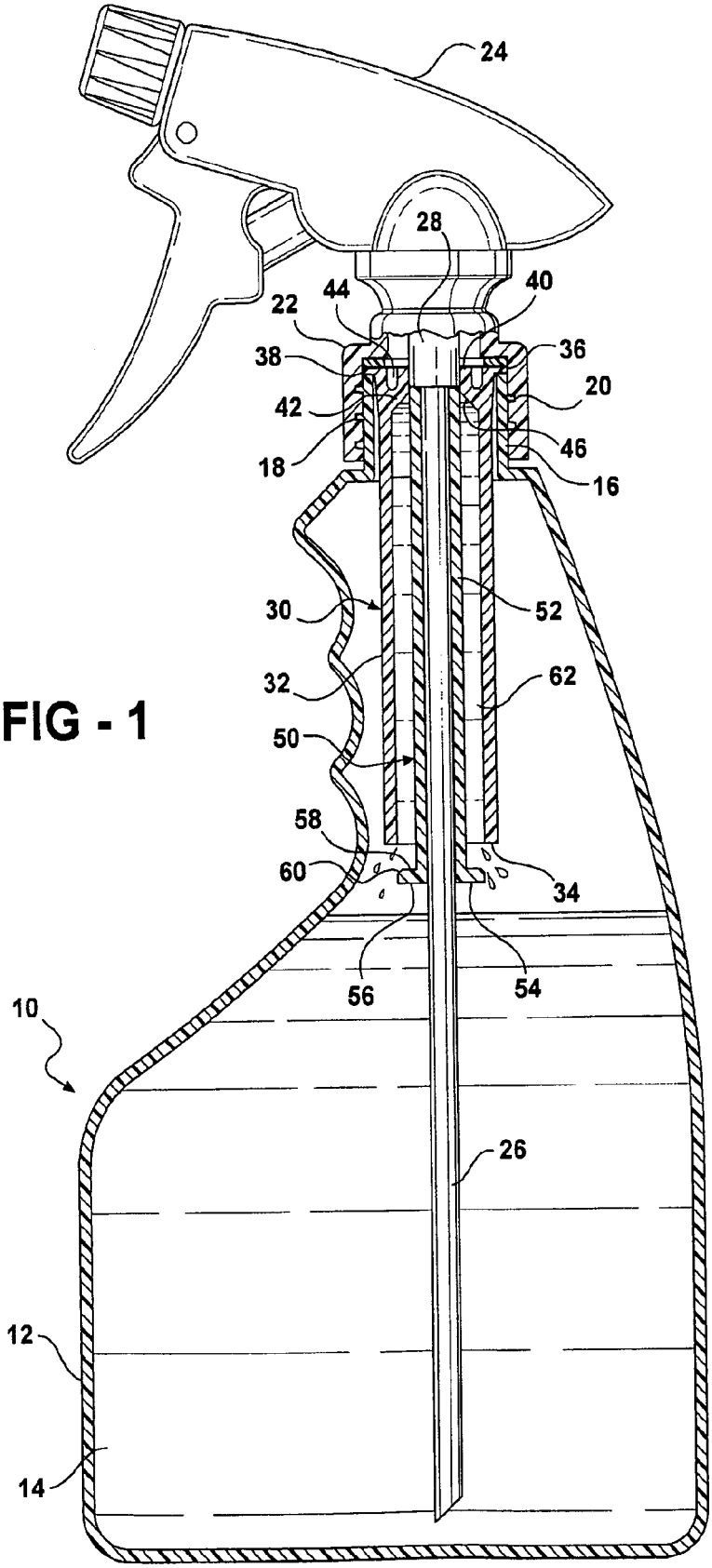
FIG. 1 is an elevational view partially in section of a container, a concentrate cartridge, and an associated dispensing device in accordance with the present invention, wherein the dispensing device is tightened on a neck portion of the container

Referring to FIG. 1 of the drawings, there is illustrated a container 10 for diluting and dispensing a concentrated material. The container 10 includes a body portion 12 including a closed base for containing a diluent fluid 14 such as water, for example, and a hollow neck portion 16. The container 10 may be produced from any conventional material known in the art such as high-density polyethylene, for example. Optionally, an outer surface of the body portion 12 may include one or more outwardly extending ridges (not shown) to facilitate a gripping thereof by a user.

The neck portion 16 is provided with external threads 18 formed on an outer surface thereof for engaging the cooperating internal threads 20 formed on an inner surface of an associated closure cap 22. Other mating means may be used such as a press fit, for example. In the embodiment shown, the neck portion 16 has a substantially circular cross-section. It is understood that the neck portion 16 can have any cross-sectional shape as desired. The closure cap 22 is adapted to form a seal at an open end of the neck portion 16 of the container 10.

The closure cap 22 is rotatingly coupled to a dispensing means provided with a depending dip tube 26. In the embodiment shown, the dispensing means is a hand pump sprayer 24.

A collar 28 is attached to the inside of the closure cap 22 and is designed to surround the upper portion of the dip tube 26. As will be explained hereinafter, the collar 28 functions to unseat a closure 56 of an associated concentrate cartridge 30.

Figure 2:
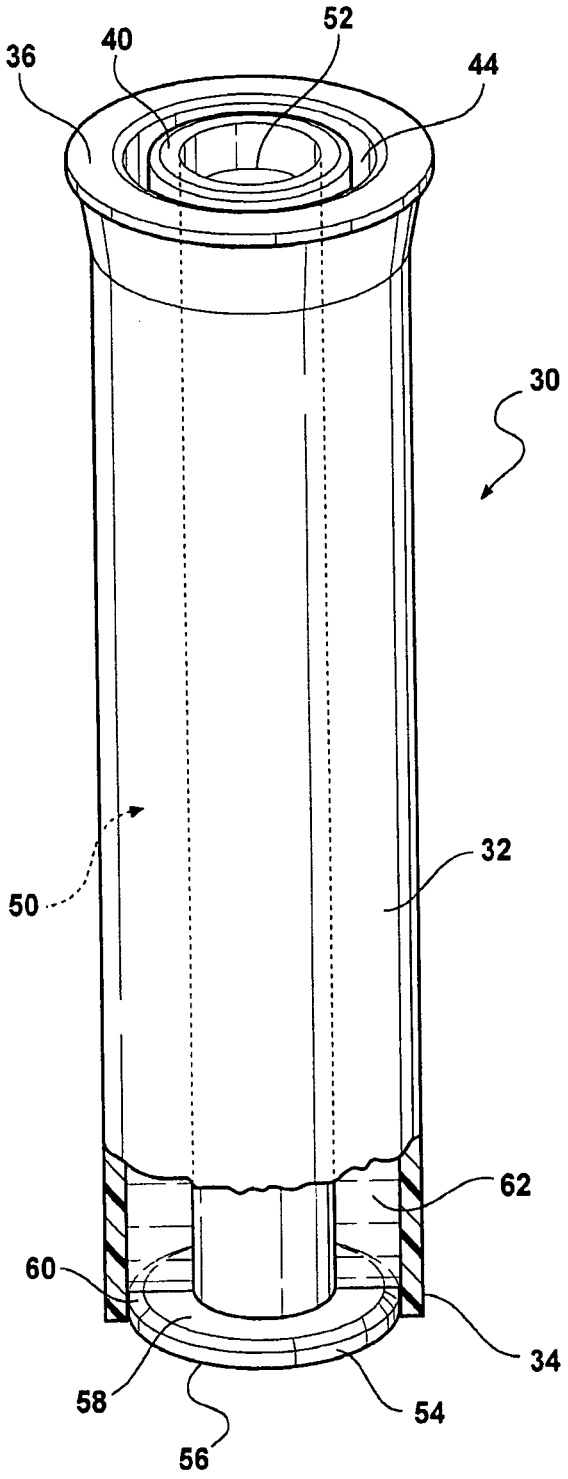
FIG. 2 is a perspective view partially in section of the cartridge.

FIG. 2 shows the concentrate cartridge 30 in accordance with an embodiment of the invention. Although a substantially circular cross-sectional shape is shown, other cross-sectional shapes can be used for the cartridge 30, such as a rectangular cross-sectional shape, for example. In the embodiment shown, the cartridge 30 is produced from conventional materials known in the art such as high-density polyethylene, for example.

Figure 3:
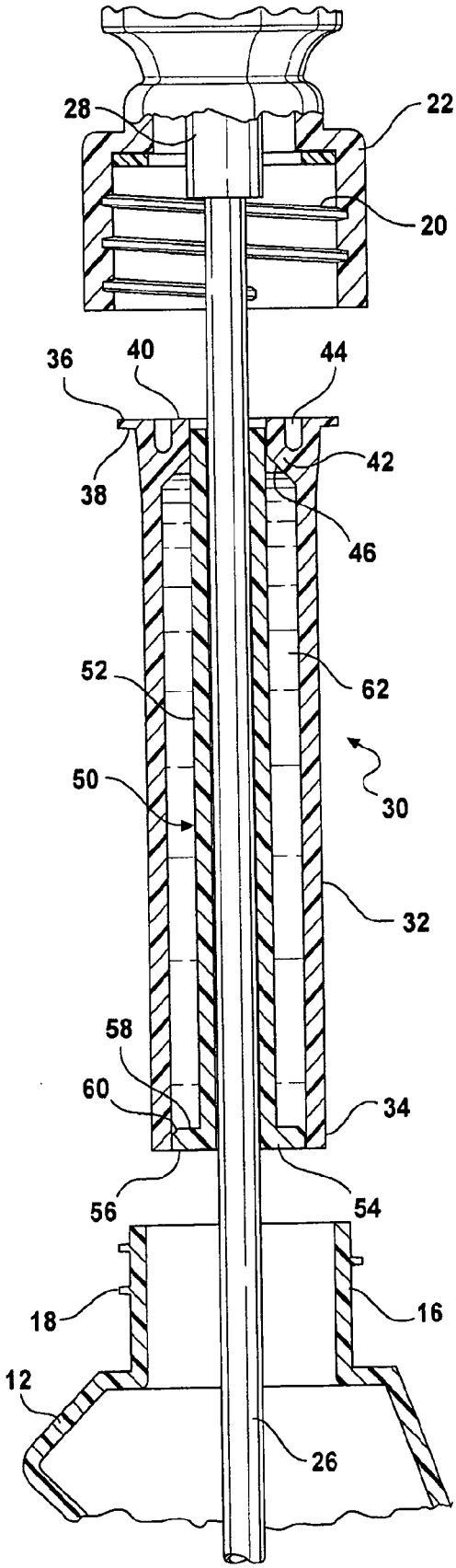
FIG. 3 is a fragmentary exploded view partially in section of the container, the cartridge, and the associated dispensing device as illustrated in FIG. 1.

The cartridge 30 having an outer diameter slightly smaller than the inside diameter of the neck portion 16, is provided with a main hollow cylindrical element 32. A lower end 34 of the hollow cylindrical element 32 is open. The opposite end is provided with an outwardly extending annular flange 36, which extends completely around the outer peripheral surface of the hollow cylindrical element 32. The juncture of the under surface of the flange 36 and the outer surface of the hollow cylindrical element 32 may be formed on a radius. As illustrated in FIG. 3, the radius terminates in a ledge 38 adapted to rest on the upper open end of the neck portion 16 of the container 10. The adjacent outer surface of the hollow cylindrical element 32 is flared outwardly slightly. The under surface of the flange 36 is generally flat and serves to support the cartridge 30 within the neck portion 16 of the container 10.

The upper end of the cartridge 30 includes an annular collar 40. The annular collar 40 is interconnected to the inner portion of the hollow cylindrical element 32 and the flange 36 by an annular web 42. It will be observed that the inner surface of the upper portion of the hollow cylindrical element 32, the annular web 42, and the outer surface of the annular collar 40 form a trough 44 which is generally U-shaped in cross-section.

The inner surface 46 formed by the juncture of the annular collar 40 and the annular web 42 is inclined inwardly and upwardly from the inner surface of the hollow cylindrical element 32 to the inner surface of the annular collar 40.

The cartridge 30 includes an associated closure member 50. The closure member 50 includes a hollow tube 52 having a radially outwardly extending closure 54 at one end thereof. The closure 54 is formed with a generally flat outer surface 56 and an opposing inner surface 58. The outer peripheral surface of the inner surface 58 is provided with an inclined camming surface or bevel 60.

The end of the hollow tube 52 opposite the end containing the closure 54 is recessed within the annular collar 40.By recessing the end of the hollow tube 52, an operator cannot manually open the closure 54 without a specially designed tool or fixture. As shown in FIG. 2, the end of the hollow tube 52 opposite the end containing the closure 54 is substantially flush with a top surface of the annular collar 40. In another embodiment shown in FIGS. 3 and 4, the end of the hollow tube 52 opposite the end containing the closure 54 is recessed with respect to the top surface of the annular collar 40.

The assembly of the hollow cylindrical element 32 and the closure member 50 is typically achieved by inserting the free end of the hollow tube 52 into the interior of the hollow cylindrical element 32 toward the open interior of the annular collar 40. This procedure is simplified by the existence of the inclined inner surface 46 which functions to readily guide the end of the hollow tube 52 into the annular collar 40. To effect a complete closure, the closure member 50 is caused to move axially within the hollow cylindrical element 32 until the camming surface 60 of the closure 54 cooperates with the lower end 34 of the hollow cylindrical element 32 to seal in a fluid-tight connection. The free end of the hollow tube 52 is recessed within the annular collar 40, as clearly illustrated in FIG. 3. As a general rule, a concentrated material 62 is inserted, manually or automatically, into the interior of the cartridge 30 before the closure member 50 is closed to seal the concentrated material 62 within the cartridge 30.

Figure 4:
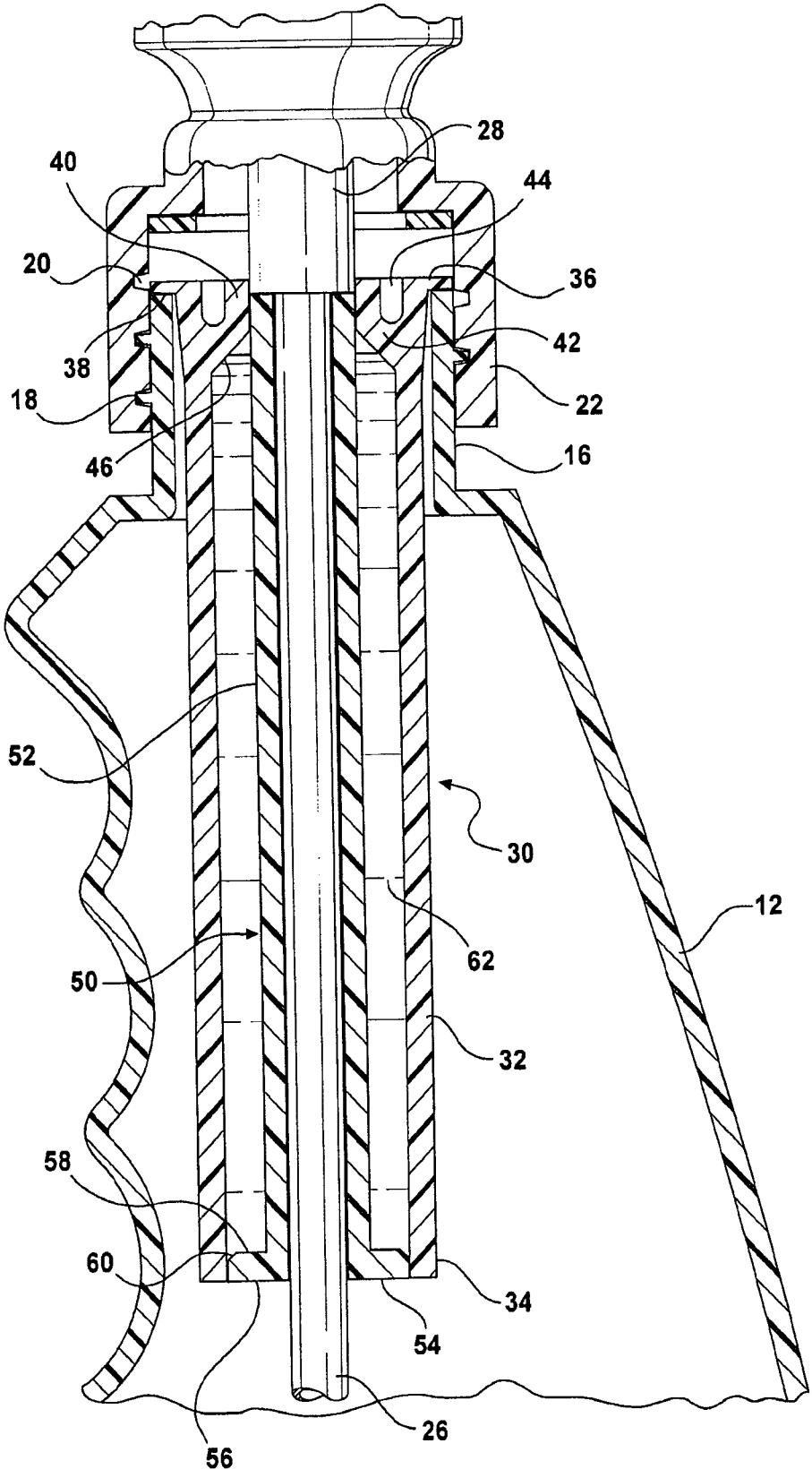
FIG. 4 is an enlarged fragmentary sectional view of the container, the concentrate cartridge, and the associated dispensing device as illustrated in FIGS. 1 and 3, wherein the dispensing device is partially tightened on the neck finish of the container.

Once filled with the concentrated material 62, the lower end 34 of the cartridge 30 is inserted into the neck portion 16 of the container 10. As shown in FIG. 4, the cartridge 30 is guided to seat properly within the neck portion 16 by the flared portion of the adjacent outer surface of the hollow cylindrical element 32. Ideally, the outer surface of the hollow cylindrical element 32 of the cartridge 30 is substantially smooth which facilitates sliding and positioning of the cartridge 30 within the neck portion 16.

When the cartridge 30 is fully inserted into the neck portion 16, the ledge 38 abuts the upper edge of the neck portion 16 to suspend the cartridge 30 within the container 10. The neck portion 16 of the container 10 is inserted into the closure cap 22 of the hand pump sprayer 24. The internal threads 20 of the closure cap 22 are mated with the external threads 18 of the neck portion 16. The closure cap 22 is rotated to affix the closure cap 22 to the container 10. As the closure cap 22 is rotated, a sealing engagement occurs between the flange 36 and the closure cap 22. Simultaneously, the top of the hollow tube 52 is contacted by the collar 28 of the closure cap 22 and urged downwardly within the hollow cylindrical element 32 of the cartridge 30. The closure 54 is thereby caused to disengage from the lower end 34 of the hollow cylindrical element 32 of the cartridge 30 to an open position, as shown in FIG. 1. Thus, allowing the concentrated material 62 to flow from the cartridge 30 into the container 10. The cartridge 30 may be refilled with concentrate and reused.

Undesirable leakage from the cartridge 30 is minimized due to the tight fit between the annular collar 40 and the hollow tube 52 and between the closure 54 and the lower end 34. Should leakage occur from between the annular collar 40 and the hollow tube 52, during shipment or storage for example, the leaked concentrated material 62 is contained within the trough 44 and permitted to dry. The trapping of the leaked concentrated material 62 militates against damage to shipping and storage containers, for example.

The cartridge is designed to prevent accidental opening by children, for example. While the preferred embodiment of the invention incorporates a collar to actuate the opening of the concentrate cartridge closure, it will be understood that other actuating means could be satisfactorily utilized. For example, in lieu of a collar, the dip tube could be provided with a radially outwardly projecting or extending detent. The detent would contact the upper end of the hollow tube and cause downward movement as the closure cap is installed.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A container system comprising:

a cartridge having a hollow tube having an end, the hollow tube recessed within an annular collar of a hollow cylindrical element thereof, wherein the end of the hollow tube is one of substantially flush with and recessed with respect to a top surface of the hollow cylindrical element;

a closure cap having a collar attached thereto, wherein the recessed hollow tube of the cartridge cannot be manually opened without engagement of the hollow tube by the collar of the closure cap or another tool or fixture; and a container having a neck portion forming an open end adapted to receive the cartridge and the closure cap and a main body having a hollow interior in communication with the neck portion.

2. The container system according to claim 1, wherein the neck portion includes external threads formed thereon adapted to engage internal threads of the closure cap.

3. The container system according to claim 1, the container further comprising a closed base portion.

4. The container system according to claim 1, wherein the main body is adapted to contain a liquid diluent and the cartridge is adapted to contain a concentrated material.

5. The container system according to claim 1, wherein the cartridge includes the hollow cylindrical element having a first open end forming a closure seat and a second end including a flange extending outwardly of the hollow cylindrical element, the annular collar, and an annular web having a generally U-shaped cross-section interconnecting the collar and the flange of the hollow cylindrical element; and the hollow tube having a first end portion in fluid-tight sliding relation with the annular collar of the hollow cylindrical element, and a second end terminating into a radially outwardly extending closure adapted to selectively seat with the closure seat of the hollow cylindrical element to form a fluid-tight closure therebetween.

6. The container system according to claim 1, wherein the hollow tube of the cartridge includes a closure having a beveled annular surface to facilitate seating with a closure seat of the hollow cylindrical element.

7. The container system according to claim 1, wherein the end of the hollow tube is substantially flush with the top surface of the hollow cylindrical element.

8. The container system according to claim 1, wherein the end of the hollow tube is recessed with respect to the top surface of the hollow cylindrical element.

9. A container system comprising:

a cartridge having a hollow tube recessed within an annular collar of a hollow cylindrical element thereof;

a closure cap having a collar attached thereto, the collar of the closure cap adapted to engage the hollow tube of the cartridge, wherein the recessed hollow tube of the cartridge cannot be manually opened without engagement of the hollow tube by the collar of the closure cap or another tool or fixture; and a container having a neck portion forming an open end adapted to receive the cartridge and the closure cap and a main body having a hollow interior in communication with the neck portion.

10. The container system according to claim 9, wherein the neck portion includes external threads formed thereon adapted to engage internal threads of the closure cap.

11. The container system according to claim 9, the container further comprising a closed base portion.

12. The container system according to claim 9, wherein the cartridge includes the hollow cylindrical element having a first open end forming a closure seat and a second end including a flange extending outwardly of the hollow cylindrical element, the annular collar, and an annular web having a generally U-shaped cross-section interconnecting the collar and the flange of the hollow cylindrical element; and the hollow tube having a first end portion in fluid-tight sliding relation with the annular collar of the hollow cylindrical element, and a second end terminating into a radially outwardly extending closure adapted to selectively seat with the closure seat of the hollow cylindrical element to form a fluid-tight closure therebetween.

13. The container system according to claim 9, wherein an end of the hollow tube is substantially flush with a top surface of the hollow cylindrical element.

14. The container system according to claim 9, wherein an end of the hollow tube is recessed with respect to a top surface of the hollow cylindrical element.

15. The container system according to claim 9, wherein contact between the collar of the closure cap and the end of hollow tube of the cartridge occurs within the hollow cylindrical element.

16. A container system comprising:

a cartridge having a hollow tube recessed within an annular collar of a hollow cylindrical element thereof;

a closure cap having a collar attached thereto, the collar of the closure cap adapted to engage the hollow tube of the cartridge, wherein contact between the collar of the closure cap and the end of hollow tube of the cartridge occurs within the hollow cylindrical element; and a container having a neck portion forming an open end adapted to receive the cartridge and the closure cap and a main body having a hollow interior in communication with the neck portion.

17. The container system according to claim 16, wherein the end of the hollow tube is substantially flush with the top surface of the hollow cylindrical element.

18. The container system according to claim 16, wherein the end of the hollow tube is recessed with respect to the top surface of the hollow cylindrical element.

19. A container system comprising:

a cartridge having a hollow tube having an end, the hollow tube recessed within an annular collar of a hollow cylindrical element thereof, wherein the end of the hollow tube is one of substantially flush with and recessed with respect to a top surface of the hollow cylindrical element;

a closure cap having a collar attached thereto, wherein contact between the collar of the closure cap and the end of the hollow tube of the cartridge occurs within the hollow cylindrical element; and a container having a neck portion forming an open end adapted to receive the cartridge and the closure cap and a main body having a hollow interior in communication with the neck portion.

* * * * *